US005535513A

United States Patent [19]

Frantz

[11] Patent Number: 5,535,513

[45] Date of Patent: Jul. 16, 1996

[54] METHOD FOR MAKING SURFACE MOUNTABLE CONNECTORS

[75] Inventor: Robert H. Frantz, Newville, Pa.

[73] Assignee: The Whitaker Corporation, Wilmington, Del.

[21] Appl. No.: 519,215

[22] Filed: Aug. 25, 1995

[51] Int. Cl.[6] ..... H01R 43/04

[52] U.S. Cl. ..... 29/882; 174/88 B; 439/83; 29/884

[58] Field of Search ..... 29/884, 882, 876, 29/DIG. 47; 439/78, 83; 174/88 B, 70 B, 71 B, 72 B

[56] References Cited

U.S. PATENT DOCUMENTS

| | | | |
|---|---|---|---|
| 4,626,637 | 12/1986 | Olsson et al. | 200/284 |
| 4,979,903 | 12/1990 | Gosselin | 439/78 |
| 4,998,887 | 3/1991 | Kaufman et al. | 439/78 |
| 5,137,454 | 8/1992 | Baechtle | 439/62 |
| 5,145,386 | 9/1992 | Berg et al. | 439/83 |
| 5,188,535 | 2/1993 | Bertho et al. | 439/83 |
| 5,277,597 | 1/1994 | Masami et al. | 439/83 |

*Primary Examiner*—P. W. Echols
*Assistant Examiner*—Adrian L. Coley
*Attorney, Agent, or Firm*—Katherine A. Nelson

[57] ABSTRACT

The present invention is directed to a method for making a connector 20 having co-planar contact surfaces including the steps of: providing a housing 22 having a plurality of contact-receiving slots 30, each having stop surfaces 32 that are precisely co-planar to define a referenced datum in the housing 22; selecting a plurality of contacts 40 having cooperating stop surfaces 44 and a surface mountable connecting portion 50 bent from a first connecting portion 42 and defining a contact surface facing away from the stop surface 44, the contacts 40 being bent at an angle slightly less than 90°; inserting the contacts 40 into respective slots 30; and striking the surface mountable contact portions with a tool having a precisely planar surface and applying force thereto until the respective stop surfaces 32,44 engage each other and the second connecting portions 50 are at precisely right angles to the respective first connecting portions 42 such that the surface mountable contact surfaces are co-planar.

5 Claims, 6 Drawing Sheets

METHOD FOR MAKING SURFACE MOUNTABLE CONNECTORS

FIELD OF THE INVENTION

This invention is directed to an electrical connectors and more particularly to a method for making connectors that are surface mounted to a substrate.

BACKGROUND OF THE INVENTION

Electrical connectors having surface mountable contacts are well known. They are typically used to avoid having to put multiple holes through circuit boards or back planes. Furthermore surface mounted connectors permit closer spacing of circuit pads on a board, which is particularly suitable with high density connectors. It is desirable in making surface mountable connectors that the surface mountable contact portions of all of the terminals in the connector are substantially in the same plane to assure that all of the contact portions engage the respective circuit pads of the boards. Various methods have been used to achieve this desired result. In U.S. Pat. No. 4,998,887, for example, the terminals are provided with spring arms that can accommodate variations in tolerances through the manufacturing process. The spring arms provide effective normal force to assure electrical continuity.

Typically connector housings have additional mounting legs or other means for securing the connector housing to the board to assure that all the surface mountable contacts remain engaged on the board so that they may be electrically connected by solder or other means known in the art. If the contact surfaces are not substantially coplanar, undue stress may be placed on the soldered connections causing the connection to break.

In one method of manufacturing surface mountable connectors, preformed terminals are inserted into appropriately configured terminal-receiving passageways. Another method of manufacturing involves inserting all the terminals into a housing and then simultaneously bending all the terminals to form the surface mountable sections. This method, however, requires considerable force.

SUMMARY OF THE INVENTION

Accordingly the present invention is directed to an improved method for making a connector having co-planar contact surfaces for surface mounting to a circuit board. The method includes providing housing having a plurality of contact receiving slots having a stop surface a first selective first distance from a mounting face, the stop surfaces of all the slots being precisely co-planar to define a referenced datum in housing; selecting a plurality of contacts, each having first and second connecting portions, the first connecting portion including a stop surface to engage the housing stop surface and a second connecting portion being bent from the first portion at a selected second distance from the cooperating stop surface; inserting the contact into the contact receiving slot until the cooperating stop surface is opposed to a respective one of the housing stop surfaces; and striking the surface mountable contact surfaces with a tool having a precisely plainer surface and applying force to the surface mountable contact surfaces until the cooperating stop surfaces engage the housing stop surface within the contact slots and each second connecting portion is at right angle to the first connecting portion; whereby the surface mountable contact surfaces are co-planar.

The present invention provides a method whereby problems associated with tolerance build up in molding housings is essentially eliminated and tolerance variations in the contacts are minimized.

A representative embodiment of the present invention will know be described by way of example with reference to the accompanying drawings.

DETAILED DESCRIPTION OF THE INVENTION

Figure 1:
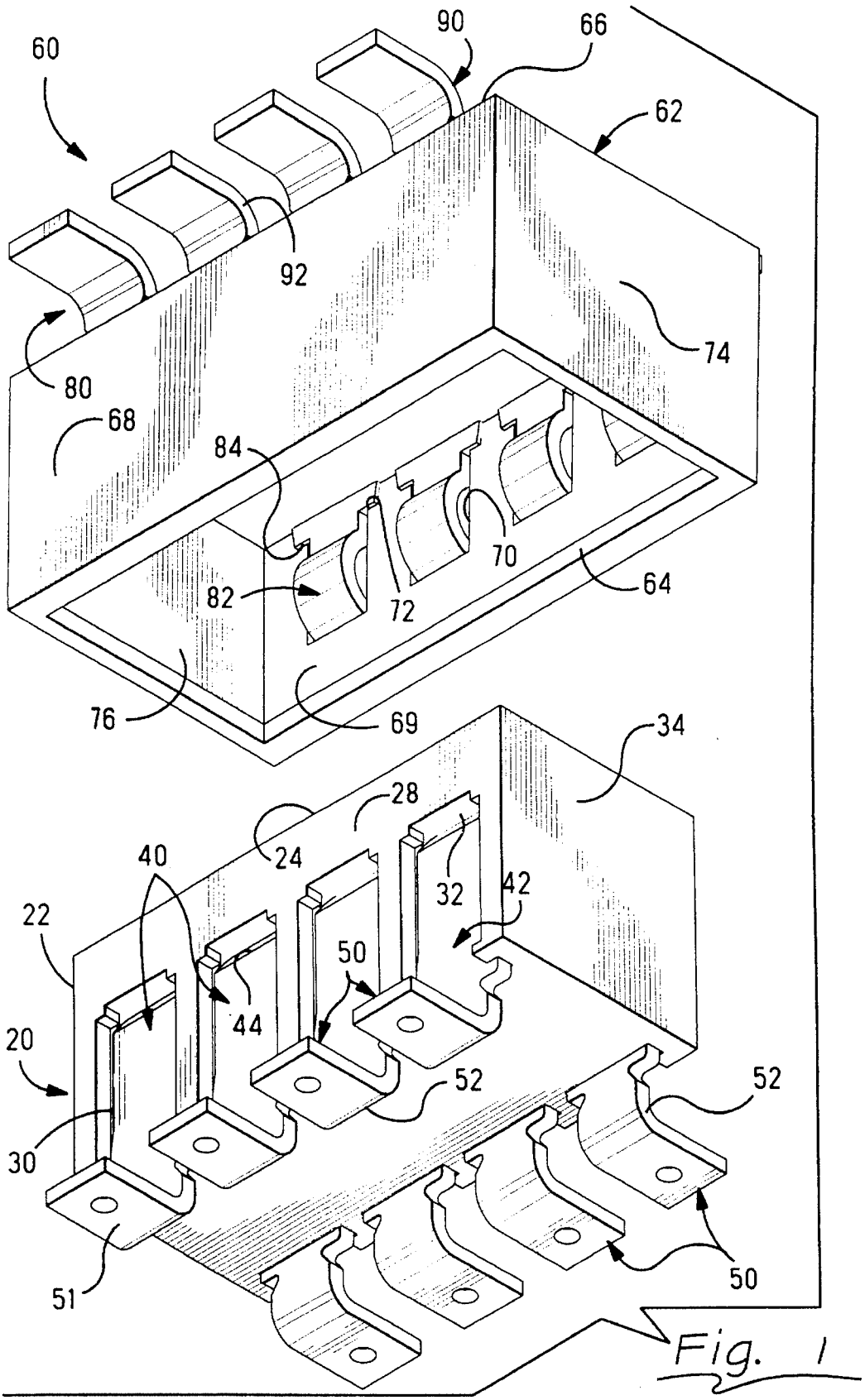
FIG. 1 is a perspective view of a representative connector assembly having a plug and receptacle made in accordance with the present invention.
Figure 6:
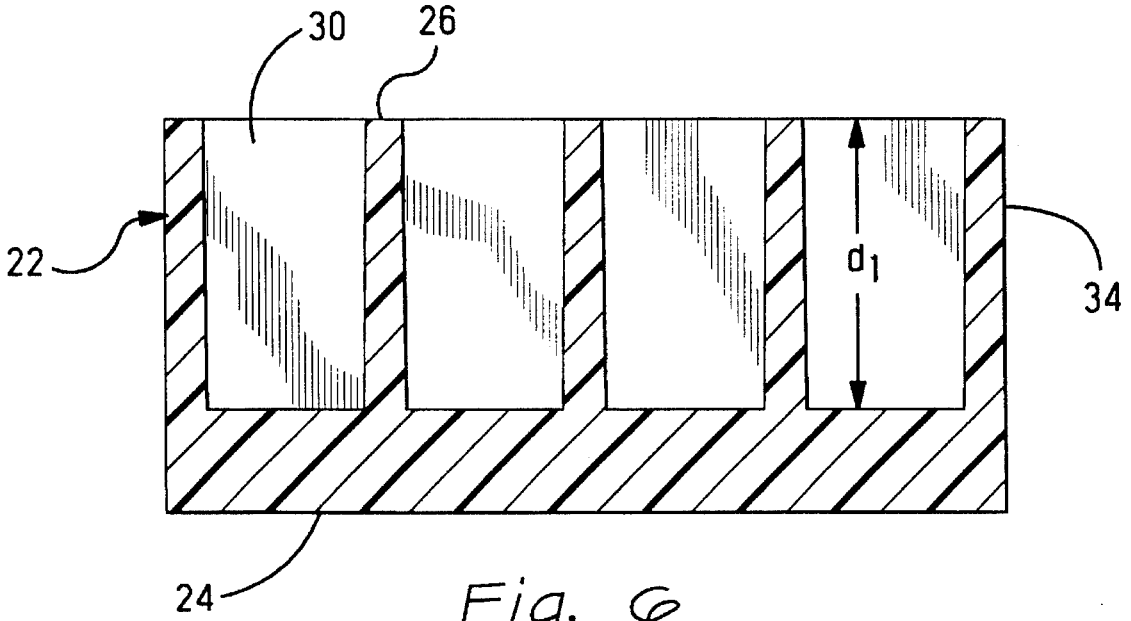
FIG. 6 is a sectional view of the housing taken along lines 6—6 of FIG. 5.

The present invention will be illustrated with reference to a connector assembly including a plug 20 having a housing 22 and a plurality of plug contacts 40 and receptacle 60 having a housing 62 and a plurality of receptacle contacts 80, as shown in FIG. 1. Referring now to FIGS. 1 through 9, plug 20 includes a housing 22 having an opposed mating and mounting faces 24, 26, opposed sidewalls 28 and opposed endwalls 34. Sidewalls 28 include a plurality of contact receiving slots 30 extending into the housing 22 from the mounting face 26 and ending at a stop surface 32. The stop surface is a selected first distance $d_1$ from the mounting face 26, as shown in FIG. 6. The stop surfaces 32 are adapted to engage a cooperating stop surface 44 on the contacts 40 as more fully explained below.

Figure 8:
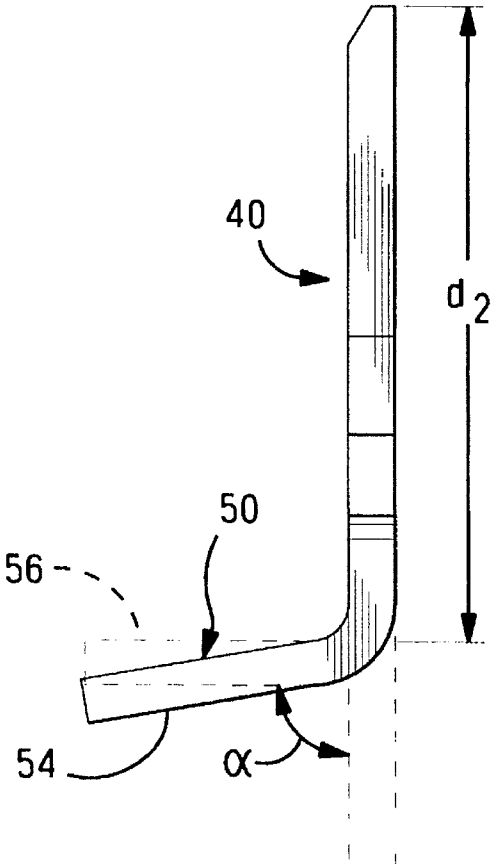
FIG. 8 is a side view of the contact of FIG. 7.
Figure 7:
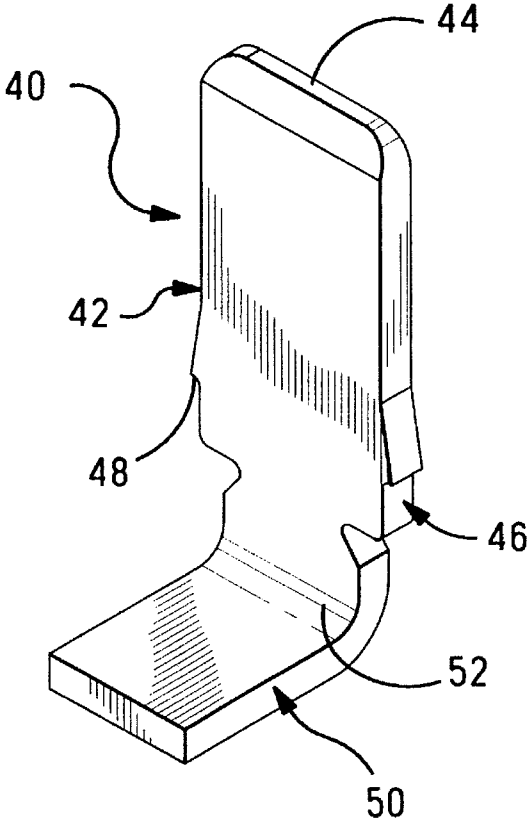
FIG. 7 is a perspective view of the plug contact made in accordance with the invention.

The plug contacts 40 as best seen in FIG. 7 have first and second connecting portions 42, 50, respectively and an intermediate body portion 46. First connecting section 42 includes the cooperating stop surface 44 at the leading end thereof which is adapted to engage the housing stop surface 32 upon full insertion of the plug contact 40 into the respective housing slot 30. The intermediate body portion 46 of the contact 40 includes retention barbs 48 which are secured in the housing wall upon full insertion thereof of the contacts 40 into the retaining contact receiving slots 30, thus securing the contact 40 within the slot 70. The second connecting portion 50 of plug contact 40 is bent from the first connecting portion 42 at a selected second distance $d_2$ from the cooperating stop surface 44 at an angle α, which is slightly less than 90° to a first position 54 as shown in FIG. 8. The selected second distance $d_2$ is greater than the selected first distance $d_1$. The bent portion defines a surface mountable contact surface 51 facing away from the cooperating stop surface 44.

Figure 4:
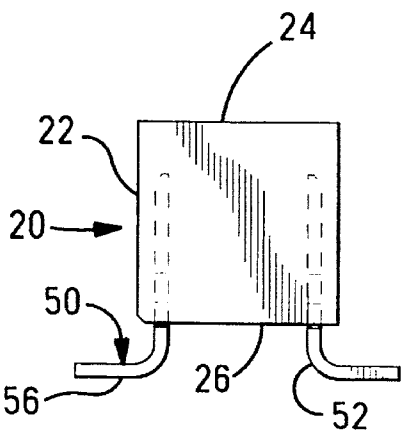
FIG. 4 is an end view of the plug of FIG. 1.
Figure 2:
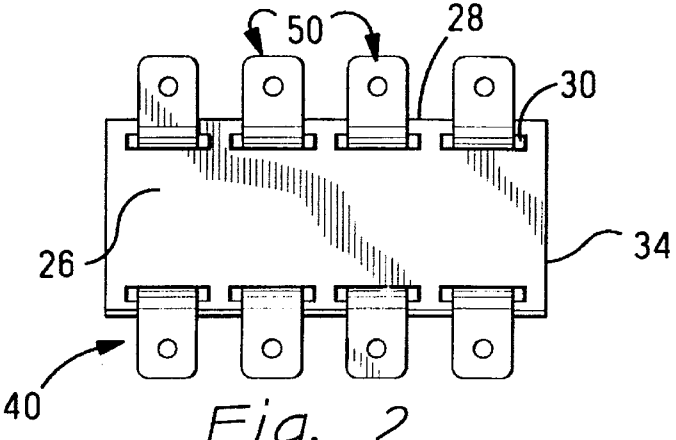
FIG. 2 is a bottom plan view of the plug of FIG. 1.
Figure 3:
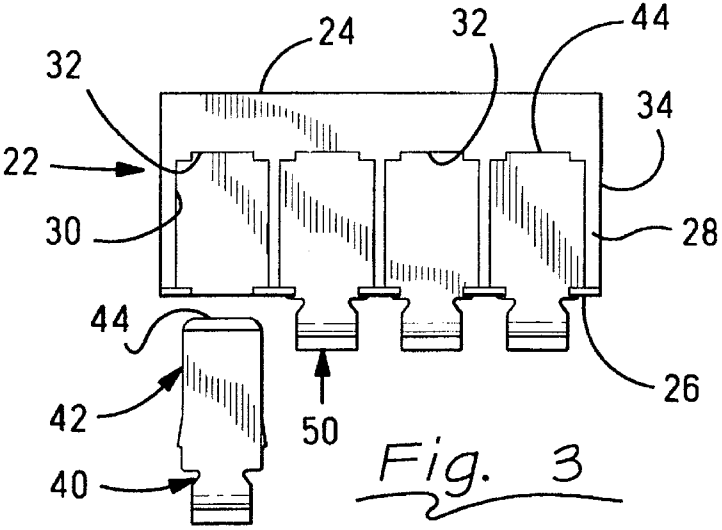
FIG. 3 is a side plan view of the plug of FIG. 1.
Figure 9:
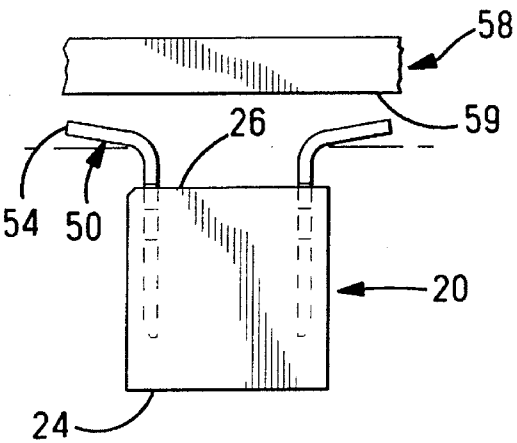
FIG. 9 is an end view of the plug connector and the tool being used in the final assembly of the connector.
Figure 5:
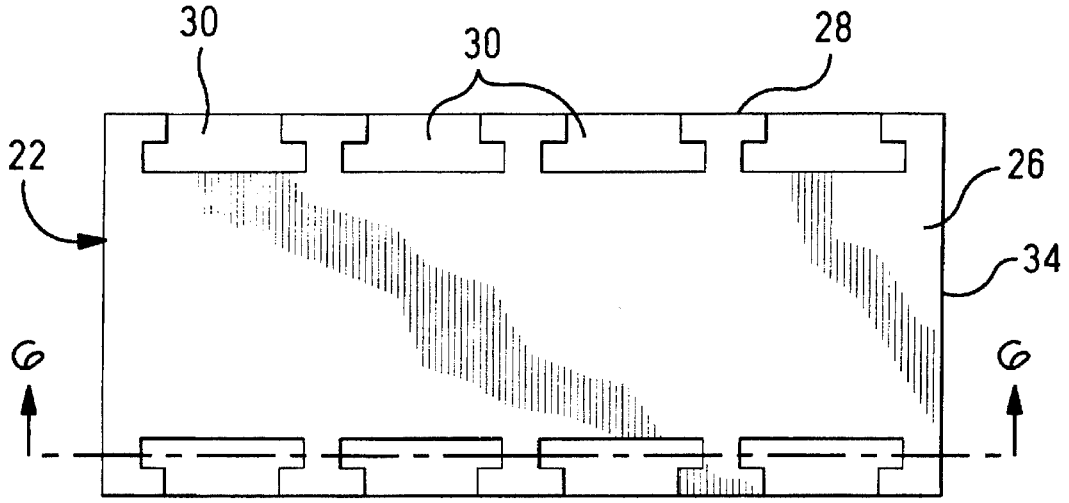
FIG. 5 is a bottom view of the housing for the plug connector of FIG. 1.

In assembling the plug 20, the contacts 40 are inserted into respective contact receiving slots 30 until each cooperating contact stop surface 44 is opposed to a respective housing stop surface 32 and the associated second connecting portion 50 faces outwardly of the mounting face 26 as shown in FIG. 9. The surface mountable contact surfaces 51 are than struck with a tool 58 having a precisely planar surface 59 and force is applied to the contact surfaces 51 until the cooperating stop surfaces 44 of the contacts 40 engage respective stop surfaces 32 the contact receiving slots 30 and each second connecting portion 50 is moved to a second position 56, which is at a right angle to the first connecting portion 43 as shown in FIGS. 3, 4 and 8. Thus any tolerance differences between the contacts 40 are accommodated by completing the bending of the contacts until the contacts 40 have been finally positioned into the housing slots 30. Upon full insertion of contacts 40 and bending the second connecting portions 50 to position 56, the surface mountable contact surfaces 51 are co-planar.

Figure 12:
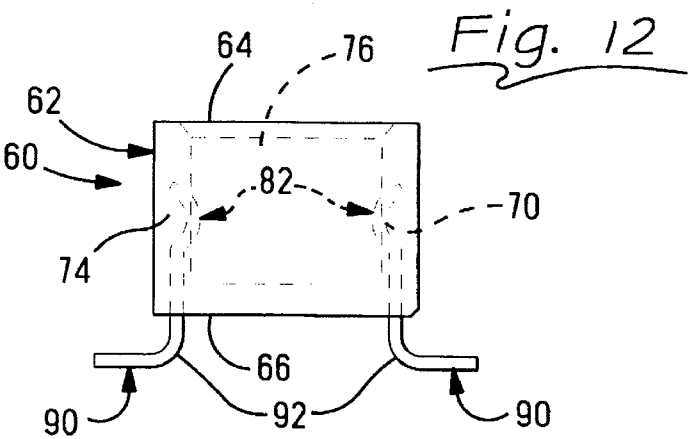
FIG. 12 is an end view of the receptacle connector of FIG. 1 with the contact showing phantom.
Figure 11:
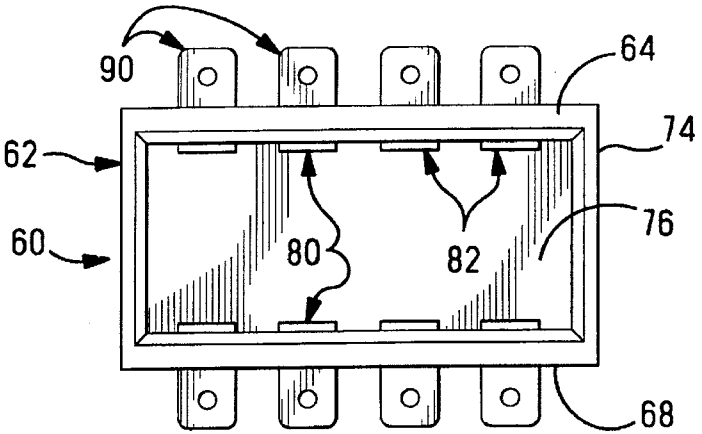
FIG. 11 is a top plan view of the receptacle FIG. 1.
Figure 13:
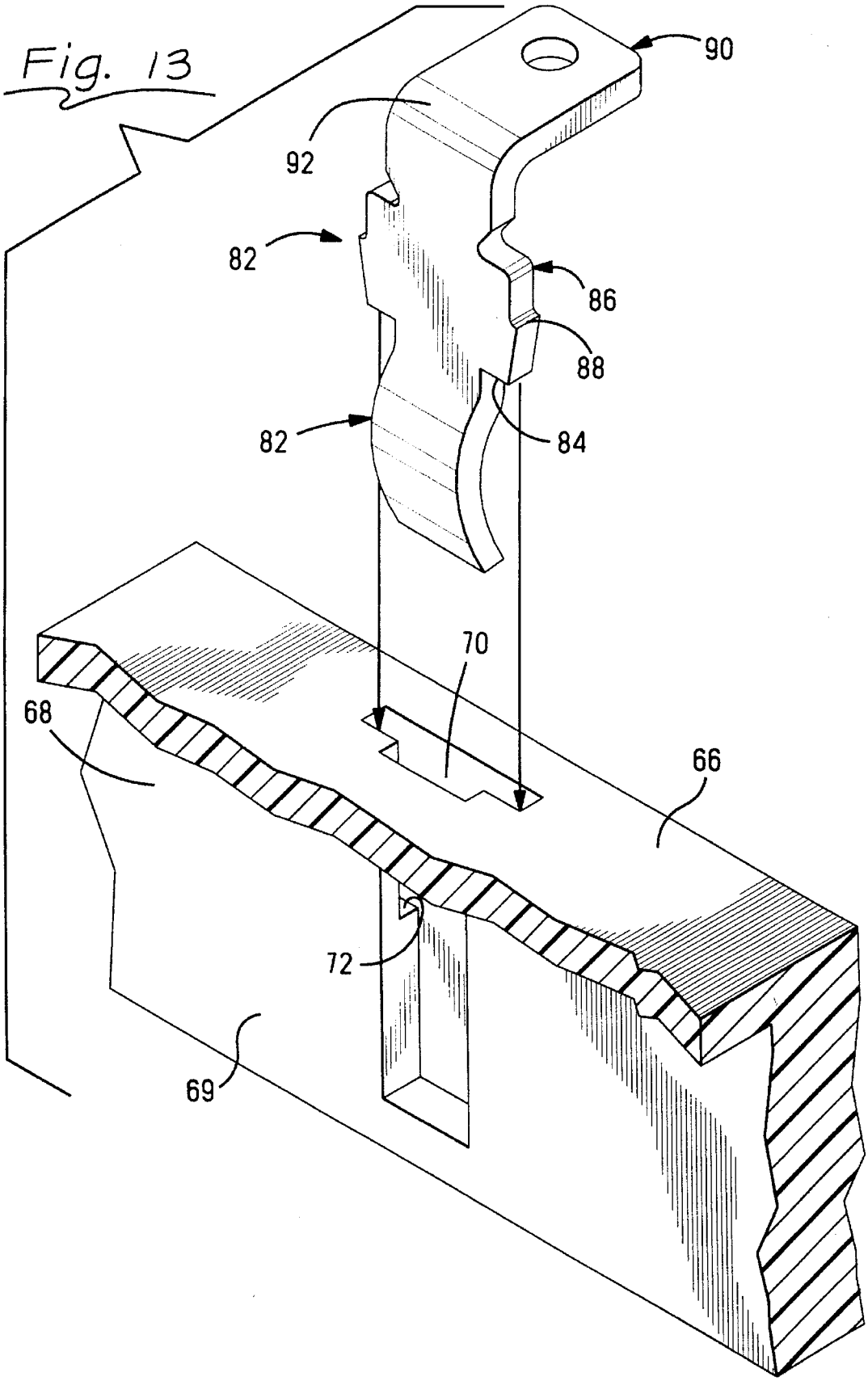
FIG. 13 is an enlarged fragmentary view of the receptacle housing and contact receiving slot thereof with a receptacle contact exploded therefrom.

FIGS. 10 through 14 illustrate a representative receptacle 60 made in accordance with the invention. Receptacle 60 includes a housing 62 having a plurality of surface mounted receptacle contacts 80 disposed therein. Housing 62 has opposed mating and mounting faces 64, 66, opposed sidewalls 68 and opposed endwalls 74 together defining a plug receiving cavity 76. Sidewalls 68 further include contact-receiving slots 70, each slot 70 including at least one stop surface 72 therein at selected third distance $d_3$ from the mounting face 66 for engaging a cooperating stop surface 84 on the receptacle contacts 80. The receptacle contacts 80 include a first connecting portion 82 a second connecting portion 90 and an intermediate body portion 86. First connecting portion 82 includes a stop surface 84 adapted for cooperating with housing stop surface 72. Intermediate body portion 86 includes retention barbs 88, which are secured in the housing wall upon full insertion thereof of the contacts 80 into the contact-receiving slots 70, thus securing contacts 80 within their respective slots 70. The second connecting portion 90 of receptacle contact 80 is bent from the first connecting portion 82 at a selected fourth distance $d_4$ from the cooperating stop surface 84 to an angle, which is slightly less than 90° in the same manner as previously described. The selected fourth distance $d_4$ is greater than the selected third distance $d_3$. The bent portion defines a surface mountable contact surface 91 facing away from the cooperating stop surface 84. Upon inserting contacts 80 into respective slots 70, the respective stop surfaces 84, 72 come engaged with the first connecting portions 82 extending through sidewall 68 and beyond the inner surface 69 thereof within cavity 76 as shown in FIGS. 11 and 12 and 13.

Figure 14:
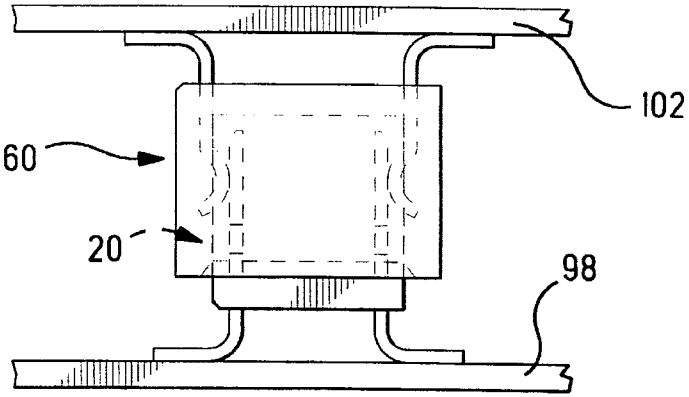
FIG. 14 is an end view of the mated connector assembly with the plug and receptacle mounted to respective circuit boards and with the plug and receptacle contacts shown in phantom.
Figure 10:
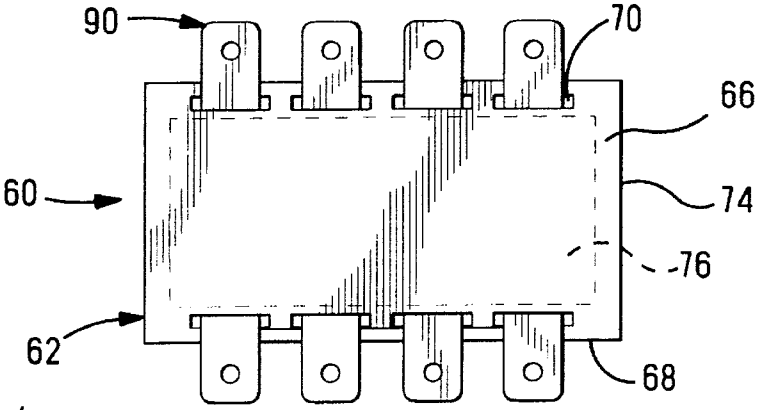
FIG. 10 is a bottom plan view of the receptacle connector of FIG. 1.

In assembling the receptacle 60, the contacts 80 are inserted in the respective contact receiving slot 70 until the cooperating stop surfaces 84, 72 are opposed. The surface mountable contact surfaces 91 are struck with the tool 58 in the same manner as previously described for the plug 20. FIG. 14 illustrates the mated connector assembly with the plug 20 and receptacle 60 mounted to circuit boards 98 and 102 respectively.

In the preferred embodiment the housing is made in a mold having a parting line that defines the reference datum of the housing. All of the individual core pin sections conclude in precisely co-planar free ends, thereby assuring the coplanarity of all the stop surfaces for all of the contact-receiving slots defining the reference datum in the housing side walls. The depths of the slots are all a first selected distance $d_1$. To assure that the contacts are precisely positioned within the housing the terminals are bent at a second selected distance to an angle α, which is less than 90°. The second selected distance is greater than the first selected distance with the bent portion defining a surface mountable contact surface facing away from the cooperating stop surface. The contacts are partially inserted into respective contact-receiving slots. A tool having a planar surface is used to fully insert the contacts into the respective slots. The planar surface of the tool is precisely parallel to the referenced datum of the housing and force is applied simultaneously to all of the contacts to insert them completely into the slots until the respective stop surfaces engage and to further bend the second connecting portions of the contacts until the bent portions are at right angles to the corresponding first connecting portions.

The present invention provides a method for making a surface mountable connector having co-planar surface mountable contact surfaces. The present invention further eliminates problems associated with tolerance build up in molding housings and minimizes the tolerance variations in the contacts used in the assemblies.

It is thought that the method for making a surface mountable connector in accordance with the present invention and many of its attendant advantages will be understood from the foregoing description. It is apparent the various changes may be made in the form, construction, and arrangement of the connector thereof without departing from the spirit or scope of the invention or sacrifice, or sacrificing of its material advantages.

I claim:

1. A method for making a connector having co-planar contact surfaces for surface mounting to a circuit board comprising the steps of:

providing a housing having a plurality of contact receiving slots in sidewalls thereof and extending to a mounting face thereof, said slots including at least one stop surface a selected first distance from said mounting face and adapted to engage a cooperating stop surface of contacts upon insertion thereof into said slots, said stop surfaces of all said slots being precisely co-planar to define a reference datum in said housing for said contacts;

selecting a plurality of contacts, each said contact having first and second connecting portions, each said first connecting portion including said cooperating stop surface and adapted to engage the housing stop surface, each said second connecting portion being bent from said first portion at a selected second distance from said cooperating stop surface and at an angle slightly less than 90°, said second selected distance being greater than said first selected distance, the bent portion defining a surface mountable contact surface facing away from said cooperating stop surfaces;

inserting each said contact into a respective contact receiving slot until said cooperating stop surface is opposed to a respective said at least one housing stop surface and said second connecting portion is spaced outwardly of said mounting face; and striking said surface mountable contact surfaces with a tool having a precisely planar surface, said planar surface of said tool being precisely parallel to said reference datum and applying force to said surface mountable contact surfaces until said cooperating stop surfaces of said contacts engage respective said stop surface of said contact receiving slots and each said second connecting portion is at a right angle to said first connecting portion;

whereby said surface mountable contact surfaces are co-planar.

2. The method for making a connector of claim 1 wherein said cooperating stop surface of said contact is at a leading edge of said first connecting portion.

3. The method for making a connector of claim 1 wherein said cooperating stop surface of said contact is spaced from a leading edge of said first connecting portion.

4. The method for making a connector of claim 1 wherein said housing is a plug.

5. The method for making a connector of claim 1 wherein said housing is a receptacle.

* * * * *